United States Patent [19]

Hansen

[11] Patent Number: 5,069,843

[45] Date of Patent: Dec. 3, 1991

[54] PROCESSING ETHYLENE TEREPHTHALATE/HEXAHYDROTEREPHTHALATE COPOLYMER FILAMENTS

[75] Inventor: Steven M. Hansen, Kinston, N.C.

[73] Assignee: E. I. Du Pont de Nemours and Company, Wilmington, Del.

[21] Appl. No.: 575,109

[22] Filed: Aug. 29, 1990

[51] Int. Cl.[5] ..... D01F 6/84

[52] U.S. Cl. ..... 264/103; 264/168; 264/210.7; 264/210.8; 264/211.15; 264/234; 264/342 RE

[58] Field of Search ..... 264/211.14, 103, 210.7, 264/210.8, 168, 235.6, 346, 211.15, 234, 342 RE

[56] References Cited

U.S. PATENT DOCUMENTS

| | | | |
|---|---|---|---|
| 2,071,251 | 2/1937 | Carothers | 264/210.8 |
| 2,465,319 | 3/1949 | Whinfield et al. | 264/210.8 |
| 3,099,064 | 7/1963 | Haynes | 264/235.6 |
| 3,719,976 | 3/1973 | Izawa et al. | 28/265 |
| 4,060,516 | 11/1977 | Kuratsuji et al. | 264/235.6 |
| 4,082,731 | 4/1978 | Knopka | 264/235.6 |

FOREIGN PATENT DOCUMENTS

| | | | |
|---|---|---|---|
| 2404479 | 1/1974 | Fed. Rep. of Germany | 264/235.6 |

*Primary Examiner*—Hubert C. Lorin

[57] ABSTRACT

A process for improving the properties of fibers of a copolymer of ethylene terephthalate/hexahydroterephthlate units with a high proportion of hexahydroterephthalate units by a 2-stage drawing, crimping, relaxing process to provide stretchy filaments of high elongation accompanied by low shrinkage.

2 Claims, No Drawings

PROCESSING ETHYLENE TEREPHTHALATE/HEXAHYDROTEREPHTHALATE COPOLYMER FILAMENTS

FIELD OF INVENTION

This invention concerns improvements in the processing of filaments of a particular copolymer, namely an ethylene terephthalate/hexahydroterephthalate copolymer of 80–86 mol % terephthalic acid/20–14 mol % hexahydroterephthalic acid components, whereby such filaments are provided with improved properties, especially their stretchiness, and the resulting filaments, e.g., in the form of tows and staple fiber cut therefrom.

BACKGROUND OF THE INVENTION

Synthetic polymer fiber is used in textile fabrics, and for other purposes. For textile fabrics, there are essentially two main fiber categories, namely continuous filament yarns and staple fiber, i.e. cut fiber. Large amounts of filaments are used in small bundles of filaments, without cutting, i.e. as continuous filament yarn, e.g. in hosiery, lingerie and many silk-like fabrics based on continuous filament yarns; the present invention is not concerned with these continuous filament yarns, but with staple fiber and its precursor tow, which are prepared by very different equipment, and which require entirely different handling considerations because of the large numbers of filaments that are handled. Staple fiber has been made by melt-spinning synthetic polymer into filaments, collecting very large numbers of these filaments into a tow, which usually contains many thousands of filaments and is generally of the order of several hundred thousand in total denier, and then subjecting the continuous tow to a drawing operation between a set of feed rolls and a set of draw rolls (operating at a higher speed) to increase the orientation in the filaments, sometimes with an annealing operation to increase the crystallinity, and often followed by crimping the filaments, before converting the tow to staple fiber, e.g. in a staple cutter. One of the advantages of staple fibers is that they are readily blended, particularly with natural fibers, such as cotton (often referred to as short staple) and/or with other synthetic fibers, to achieve the advantages derivable from blending, and this blending may occur before the staple cutter, or at another stage, depending on process convenience.

Synthetic polyester fibers have been known and used commercially for several decades, having been first suggested by W. H. Carothers, U.S. Pat. No. 2,071,251, and then by Whinfield and Dickson, U.S. Pat. No. 2,465,319. Most of the polyester polymer that has been manufactured and used commercially has been poly(ethylene terephthalate), sometimes referred to as 2G-T. This polymer is often referred to as homopolymer. Commercial homopolymer is notoriously difficult to dye. Such homopolymer is mostly dyed with disperse dyestuffs at high temperatures under elevated pressures, which is a relatively expensive and inconvenient process (in contrast to processes for dyeing several other commercial fibers at atmospheric pressure, e.g. at the boil), and so there have been several suggestions for improving the dyeability of polyester yarns. For instance, Griffing and Remington, U.S. Pat. No. 3,018,272, suggested the use of cationic-dyeable polyesters. Such polyesters, consisting essentially of poly [ethylene terephthalate/5-(sodium sulfo) isophthalate] containing about 2 mol % isophthalate groups in the polymer chain (2GT/SSI), have been used commercially as a basis for polyester yarns for some 20 years.

Although such polyester fibers have been very useful, it has long been desirable to provide alternative fibers, having the desirable characteristics of commercial polyester fibers accompanied by excellent dyeing properties.

Watson, in U.S. Pat. No. 3,385,831, suggested textile fibers of copolymers of polyethylene terephthalate/hexahydroterephthalate. These fibers showed a surprising combination of enhanced dyeability and good overall physical properties, including low shrinkage values. These copolymer fibers are rather unique, considering the unusually large molar amounts of comonomer (i.e. the hexahydroterephthalate units, HT) in comparison with other comonomers in polymers with ethylene terephthalate (2G-T). Despite the advantages on paper, however, Watson's fibers were not produced in commercial quantities. Some reasons are believed to be the poor stretchiness and relatively high sensitivity to elevated temperatures of Watson's fibers. As indicated, several properties do get less desirable as the proportion of comonomer is increased, although the dyeability is correspondingly improved. The improved dyeability from higher proportions of HT comonomer would have been very desirable, if such problems could have been solved.

An object of the present invention is to improve the properties of Watson's type of fibers of copolymers containing ethylene terephthalate (2G-T) and ethylene hexahydroterephthalate (2G-HT) units.

BRIEF SUMMARY OF THE INVENTION

According to one aspect of the invention, there is provided a process for preparing a tow of crimped fibers of ethylene terephthalate/hexahydroterephthalate copolymer of 80–86 mol % terephthalic acid/20–14 mol % hexahydroterephthalic acid components, said fibers having an elongation of at least 25% with a Dry Heat Shrinkage (measured at 160° C.) of less than 10%, including the steps of melt-spinning said copolymer into filaments, forming a tow from a multiplicity of said filaments, and subjecting said tow to 2 stages of drawing, followed by crimping, and then relaxing by heat-treating the filaments in a tension-less state at a temperature of about 120° to about 145° C. to reduce the shrinkage.

According to another aspect of the invention, the resulting filaments and cut fibers are also provided.

DETAILED DESCRIPTION OF THE INVENTION

The particular copolymers and many of the details of their preparation and processing into fibers are described in Watson, U.S. Pat. No. 3,385,831, the disclosure of which is hereby specifically incorporated by reference. However, according to the present invention, it has proved possible to improve the properties of the fibers sufficiently so that the molar proportion may be as high as about 20 mol % of the hexahydroterephthalate(HT) comonomer component, i.e. about 12–20 mol % may be used, about 16–18% being preferred, especially about 17%. It is most unusual to find a satisfactory polymer of such high comonomer content, and much of the art prescribes that the amount should not exceed 15 mol %. Indeed, as indicated, as little as 2 mol % is used commercially for the 2G-T/SSI fiber.

Preferred drawing conditions for conventional polyester filaments have been disclosed in the art, e.g. Vail U.S. Pat. No. 3,816,486, the disclosure of which is also hereby specifically incorporated by reference. Generally, the apparatus described and illustrated by Vail may be used to practice the present invention, subject to the comments herein. In particular, Vail's recommendations about temperatures should be modified, as noted herein. Indeed, the process of the present invention must be carried out between critical temperature limits, as indicated in the Examples, hereinafter. A slightly higher temperature, such as 150° C., was found to render the process of Example 1 inoperable, whereas too low a temperature (such as 115° C.) gave fibers whose shrinkage was too high to be generally useful in textiles. In this regard, however, as will be understood by those skilled in the art, the precise temperature limits for any particular fibers will depend on the actual fibers and conditions applied, for instance higher viscosity polymer will give greater resistance to higher temperatures, as a general rule.

The invention is further illustrated in the following Examples, and maybe contrasted with the process taught by Watson, in U.S. Pat. No. 3,385,831. The fiber properties were measured on filaments from the crimped tow for convenience. The DHS was measured at 160° C.

EXAMPLE 1

A random copolymer of 17 mol % polyethylene hexahydroterephthalate and 83 mol % polyethylene terephthalate was prepared by ester exchange and polycondensation reactions to a fiber grade molecular weight with relative viscosity =20.5 LRV (IV =0.63). The polymer was melt-spun in a conventional manner using a spinneret temperature of 275° C. and was wound up at 1500 ypm to give a yarn having 625 filaments and a total denier of 1875.

Bundles of yarn were collected together to form a tow of approximately 56250 filaments which was drawn in two stages, then crimped, then heat-treated in tensionless condition, and then cut to staple fiber. Fibers in this Example were drawn to a total draw ratio of 2.95X, crimped to a level of 8–12 crimps per inch, and heat-treated in a relaxer oven with a residence time of 8 minutes at the relaxer temperatures in Table 1. The fibers were in a tensionless state, so they were able to relax during the heat-treatment process. In this Example, relaxation of 40–60% occurred after the drawing stage, i.e. in the crimper and relaxer oven. Increasing the heat-treatment temperature decreased the shrinkage (both boil-off shrinkage [BOS] and dry heat shrinkage [DHS]) and shrinkage tension (ST) of the fibers. As can be seen, a temperature of 115° C. gave fibers of DHS too high to be of value in a textile; this first item is not according to the invention. The maximum operable treatment temperature for these fibers was determined to be 145° C. (At a treatment temperature of 150° C., these fibers fused and adhered together forming a stiff, boardy tow that was not suitable for textile processing.) Physical and thermal properties of fibers produced by this process are given in Table 1.

TABLE 1

| Total DR | Relaxer Temp (°C.) | DPF | Ten (GPD) | $T_7$ (GPD) | % E | BOS (%) | DHS (%) | ST (MGPD) |
|---|---|---|---|---|---|---|---|---|
| 2.95 | 115 | 1.44 | 3.4 | 0.7 | 38.7 | 1.5 | 12.8 | 26 |
| 2.95 | 130 | 1.47 | 3.6 | 0.7 | 43.0 | 0.4 | 8.4 | 22 |
| 2.95 | 145 | 1.54 | 3.2 | 0.7 | 43.0 | 0.4 | 4.7 | 18 |

EXAMPLE 2

The random copolymer described in Example 1 was prepared at an increased molecular weight to a relative viscosity of 24 LRV (IV approximately 0.72). The polymer was spun in a conventional matter using a spinneret temperature of 285° C. and was wound up at 1450 ypm to give a yarn having 900 filaments and a total denier of approximately 2950.

Bundles of yarn were collected together forming a tow of approximately 45000 filaments which were drawn in two stages (using different draw ratios, as in Table 2), crimped, heat-treated without tension in an oven at 125° C. for 8 minutes, and cut. The physical properties of the fibers produced using this process are also given in Table 2.

TABLE 2

| Total DR | Relaxer Temp (°C.) | DPF | Ten (GPD) | $T_7$ (GPD) | % E | BOS (%) | ST (MGPD) |
|---|---|---|---|---|---|---|---|
| 2.80 | 125 | 1.45 | 4.7 | 1.0 | 35.3 | 1.0 | 49 |
| 2.90 | 125 | 1.43 | 4.6 | 0.9 | 29.9 | 0.9 | 44 |
| 3.00 | 125 | 1.37 | 5.0 | 1.0 | 27.1 | 1.2 | 48 |
| 3.20 | 125 | 1.30 | 6.5 | 1.2 | 29.2 | 1.3 | 60 |

This process can be used to produce fibers with a significantly higher tenacity than fibers produced by Watson. The relative disperse dyeability (RDDR) of the relaxed copolymer fibers is approximately 10 times that of standard homopolymer fiber.

EXAMPLE 3

A polymer with the same relative ratios of polyethylene hexahydroterephthalate and polyethylene terephthalate as in Example 1 with the addition of 0.0005 lb./lb. of polymer of tetraethyl silicate viscosity booster was made to a relative viscosity of approximately 16 LRV (I.V. approximately 0.57). The polymer was melt-spun in a conventional manner using a spinneret temperature of 275° C. and was wound up at 1200 ypm to give a yarn having 1054 filaments and a total denier of 5250.

Bundles of fibers were collected together forming a tow of approximately 42150 filaments which were drawn in two stages, crimped, heat-treated without tension, and cut, essentially as in Example 1 to provide fiber with properties given in Table 3.

TABLE 3

| Total DR | Relaxer Temp (°C.) | DPF | T (GPD) | $T_{10}$ (GPD) | % E | BOS (%) | RDDR (%) | Dye Rate |
|---|---|---|---|---|---|---|---|---|
| 3.87 | 130 | 1.74 | 2.5 | 0.9 | 45.3 | 2.2 | 495 | 0.256 |

The RDDR relative dispersed dye uptake (with carolid carrier) of the fiber produced by this process was compared to a standard polyethylene terephthalate control and was found to be 495 vs. 100 assigned to the control. The dye rate of the copolymer was found to be 0.256 versus a rate of approximately 0.05 for a typical polyethylene terephthalate fiber.

I claim:

1. Process for preparing a tow of crimped fibers of ethylene terephthalate/hexahydroterephthalate copolymer of 80–86 mol % terephthalic acid/20–14 mol % hexahydroterephthalic acid components, said fibers having an elongation of at least 25% with a Dry Heat Shrinkage (measured at 160° C.) of less than 10%, including the steps of melt-spinning said copolymer into filaments, forming a tow from a multiplicity of said filaments, and subjecting said tow to 2 stages of drawing, followed by crimping, and then relaxing by heat-treating the filaments in a tension-less state at a temperature of about 120° to about 145° C. to reduce the shrinkage.

2. Process according to claim 1, wherein said copolymer contains 16–18 mol % of hexahydroterephthalic acid components and 84–82 mol % of terephthalic acid components.

* * * * *